US012742263B2

(12) United States Patent
Mora et al.

(10) Patent No.: US 12,742,263 B2
(45) Date of Patent: Sep. 22, 2026

(54) PROCESS FOR UTILIZING OFF-COLOR FILAMENT YARNS

(71) Applicant: DUPONT SAFETY & CONSTRUCTION, INC., Wilmington, DE (US)

(72) Inventors: Aline Ferreira Mora, Sao Paulo (BR); Olivier Beat Noth, Fribourg (CH)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 0 days.

(21) Appl. No.: 19/228,341

(22) Filed: Jun. 4, 2025

(65) Prior Publication Data

US 2026/0055538 A1 Feb. 26, 2026

Related U.S. Application Data

(60) Provisional application No. 63/656,675, filed on Jun. 6, 2024.

(51) Int. Cl.

| | |
|---|---|
| ***D01G 1/04*** | (2006.01) |
| ***D01G 1/08*** | (2006.01) |
| ***D01G 1/10*** | (2006.01) |
| ***D01G 13/00*** | (2006.01) |

(52) U.S. Cl.
CPC ..... *D01G 1/04* (2013.01); *D01G 1/08* (2013.01); *D01G 1/10* (2013.01); *D01G 13/00* (2013.01)

(58) Field of Classification Search
CPC ..... D01G 1/10; D01G 1/08; D01G 1/04; D01G 13/00
See application file for complete search history.

(56) References Cited

U.S. PATENT DOCUMENTS

| | | | | | |
|---|---|---|---|---|---|
| 1,929,344 | A * | 10/1933 | Benoit | D01G 13/00 | 19/145.5 |
| 2,233,418 | A * | 3/1941 | Kline | D01G 1/10 | 242/365.6 |
| 2,842,803 | A * | 7/1958 | Hunter | D01G 13/00 | 19/145.5 |
| 2,929,801 | A | 3/1960 | Koller | | |
| 2,929,802 | A | 3/1960 | Katz | | |
| 2,929,803 | A | 3/1960 | August et al. | | |
| 2,929,804 | A | 3/1960 | Steuber | | |
| 2,953,839 | A | 9/1960 | Kohrn et al. | | |
| 2,956,985 | A * | 10/1960 | Huffman | C08G 63/82 | 560/92 |
| 2,957,852 | A | 10/1960 | Frankenburg et al. | | |
| 2,962,470 | A | 11/1960 | Jung | | |
| 2,999,839 | A | 9/1961 | Arvidson et al. | | |
| 3,009,901 | A | 11/1961 | Frazer | | |
| 3,930,285 | A * | 1/1976 | Wornall | D01G 21/00 | 19/0.56 |
| 4,107,909 | A | 8/1978 | Fehrer et al. | | |
| 4,249,368 | A | 2/1981 | Fehrer | | |
| 4,327,545 | A | 5/1982 | Fehrer | | |
| 4,473,617 | A * | 9/1984 | van Leeuwen | D01F 1/04 | 57/244 |
| 4,994,323 | A | 2/1991 | Lee | | |
| 5,114,652 | A | 5/1992 | Lee | | |
| 5,609,484 | A * | 3/1997 | Hawiuk | A45D 44/005 | 434/94 |
| 6,023,925 | A * | 2/2000 | Schnegg | D01G 13/00 | 19/145.5 |
| 6,112,384 | A * | 9/2000 | Barnes | D01G 13/00 | 28/100 |
| 6,421,883 | B1 * | 7/2002 | Staheli | D01G 13/00 | 19/205 |
| 6,952,915 | B2 | 10/2005 | Prickett | | |
| 2004/0053047 | A1 * | 3/2004 | Jackson | D01F 6/90 | 428/373 |
| 2009/0173055 | A1 * | 7/2009 | Silver | D02G 3/04 | 57/400 |
| 2016/0002829 | A1 * | 1/2016 | Lightman | D04H 1/04 | 19/65 R |
| 2017/0120513 | A1 * | 5/2017 | Brennan | B29B 7/404 | |
| 2018/0305847 | A1 * | 10/2018 | Wen | D04B 21/202 | |
| 2019/0106812 | A1 * | 4/2019 | Park | D01H 13/306 | |
| 2020/0040490 | A1 * | 2/2020 | Jain | D03D 15/217 | |
| 2024/0018696 | A1 * | 1/2024 | Shah | D01G 5/00 | |
| 2025/0353944 | A1 * | 11/2025 | Yao | D04H 1/43828 | |

FOREIGN PATENT DOCUMENTS

| | | |
|---|---|---|
| CN | 104372477 A | 2/2015 |
| CN | 104611797 A | 5/2015 |
| EP | 3521494 A1 | 8/2019 |

OTHER PUBLICATIONS

PCT International Search Report for Application No. PCT/US2025/031856; Didier Pollet, Authoized Officer; ISA/EPO; Sep. 26, 2025.

* cited by examiner

*Primary Examiner* — Bao-Thieu L Nguyen
(74) *Attorney, Agent, or Firm* — Ram W. Sabnis

(57) ABSTRACT

A process for utilizing wound packages of off-color filament yarn by:

a) obtaining a plurality of wound packages of off-color filament yarn:
b) classifying the plurality of wound packages, based on a pigment in the filament, into sets of wound packages;
c) converting a first set of wound packages into first staple fibers;
d) converting a second set of wound packages into second staple fibers;
e) mixing the first and second staple fibers of c) and d) to form an intimate blend of off-color staple fibers;

wherein the first staple fibers are at least 55 weight percent of the off-color staple fibers in the intimate blend of off-color staple fibers.

15 Claims, No Drawings

PROCESS FOR UTILIZING OFF-COLOR FILAMENT YARNS

BACKGROUND OF THE INVENTION

Field of the Invention

This invention relates to the use of off-color filament yarns in useful products, avoiding the need to landfill these yarns.

Description of Related Art

U.S. Pat. No. 5,114,652 to Lee discloses a process for preparing colored para-aramid fibers. These fibers contain an organic pigment in an amount sufficient to provide the desired color intensity. The process involves such steps as forming a uniform solution of pigment and polymer, extruding that solution through a spinneret, passing the extrudate through an aqueous coagulation bath to form filaments, and washing the filaments, and ultimately winding the filaments on bobbins or cores to make wound packages.

The manufacture of filament yarns on a modern spinning machine in a continuous process involves making a spinning dope, the extruding the spinning dope into filaments, combining those filaments into a yarn, and then winding that yarn onto a bobbin or core to make a wound package. Once the desired amount of yarn is on a bobbin, that bobbin of yarn is doffed or removed from the machine, while simultaneously replacing the wound bobbin with an empty bobbin onto which yarn can continue to be made and wound.

When the yarns comprise pigmented filaments, there is a propensity for additional waste. For example, it is not unusual to transition from making a yarn of unpigmented filaments to a yarn of pigmented filaments by on-line injection of pigment into the spinning dope prior to extruding filaments. This means that some yarn made at the initiation of the injection and soon thereafter (the transition period) will not have the desired amount of pigment and must be segregated; and in many cases this yarn will be designated as waste. Further, it may take some time for the pigmented process to stabilize, and while it is stabilizing and the desired pigment amount is confirmed in the filaments, the continuous process can make multiple wound bobbins of yarn that will be segregated. The same thing can happen when the pigment is changed to change the color of the yarn; some quantity of pigmented yarn is wound on bobbins as the continuous process transitions from one colored product to another. (However, it is more common to transition from one pigment to another by first transitioning to pigment-free and then to the new pigment.)

Additionally, processes that can make pigmented yarns generally make a number of different colored yarns, which can create substantial amounts of off-color yarns. The tendency is to simply landfill any off-color yarn as it is difficult to recycle due to the presence of the pigment. However, this is not a desirable outcome. What is needed is a method of utilizing these off-color yarns and reduce the amount that must be landfilled.

BRIEF SUMMARY OF THE INVENTION

This invention relates to a process for utilizing wound packages of off-color filament yarn, comprising:

a) obtaining a plurality of wound packages of off-color filament yarn, wherein the wound packages that contain off-color filament are:

i) wound packages of filament containing filament having linear lengths with pigment and linear lengths without pigment, ii) wound packages of filament containing filament having an amount of pigment outside desired pigment amount limits, iii) wound packages of filament containing filament having a linear length of one pigment and another linear length of a differing pigment, iv) wound packages of filament containing filament having a mixture of different pigments, and each of those individual pigments are present in varying amounts linearly along the filament, or v) any combination of i) to iv) thereof;

b) classifying the plurality of wound packages, based on a pigment in the filament, into sets of wound packages;

c) converting a first set of wound packages into first staple fibers;

d) converting a second set of wound packages into second staple fibers;

e) mixing the first and second staple fibers of c) and d) to form an intimate blend of off-color staple fibers;

wherein at least 55 weight percent of the staple fibers in the intimate blend of off-color staple fibers is first staple fibers, based on the total weight of off-color staple fibers in the intimate blend of off-color staple fibers.

DETAILED DESCRIPTION OF THE INVENTION

This invention related to a process for utilizing wound packages of off-color filaments yarn to make an intimate blend of staple fibers that has a dominant color that can be further processed in to staple fiber yarns, including plied yarns; knit or other fabrics; or articles such as gloves, aprons or sleeves.

For purposes herein, the term "fiber" is defined as a relatively flexible, macroscopically homogeneous body having a high ratio of length to the width of the cross-sectional area perpendicular to that length. The fiber cross section can be any shape, depending on the polymer and its processing, but is typically round or bean shaped. Also, such fibers preferably have a generally solid cross section for adequate strength in textile uses; that is, the fibers preferably are not appreciably voided or do not have a large quantity of objectionable voids. Fibers obtained directly from a filament spinning process and typically collected onto a bobbin or core in a wound package are referred to as continuous fibers or filaments. Such continuous fibers or filaments can be converted into short lengths called staple fiber, which refers to fibers that are cut to a desired length or are stretch broken. Staple fibers have a lower ratio of length to the width of the cross-sectional area perpendicular to that length when compared with continuous filaments. Man-made staple fibers are cut or made to a length suitable for processing on, for example, cotton, woolen, or worsted yarn spinning equipment. Staple fibers can have (a) substantially uniform length, (b) variable or random length, or (c) a substantially uniform distribution of lengths.

In some embodiments, the fibers have a linear density of 1 to 3 dtex (0.9 to 2.7 denier), which is a fiber size that is especially useful in the manufacture of woven and knit textiles. This linear density range essentially provides fibers that have a minimum cross-sectional diameter, measured at any point on the fiber, that is greater than about 5 microns.

By "intimate blend", it is meant the staple fibers obtained from the various wound packages are uniformly mixed together such that a high concentration of any one type of fiber from any wound package is avoided in the blend.

The intimate blend can be made by cutter blending continuous filament yarns from different sets of wound packages, or by blending different bales of fibers (each bale having staple fibers from a single set of wound packages) and other means known in the art of forming an intimate blend. For example, the two or more slivers of different staple fiber types, each obtained from differing sets of wound packages, can be blended prior to or while a staple fiber yarn is being spun so that the various staple fibers are distributed homogeneously as an intimate blend in the staple yarn bundle.

The term "staple fibers" as used herein include fibers made by cutting filaments into lengths of no more than about 15 cm (5.9 inches), preferably 3 to 15 cm (1.2 to 5.9 inches); and most preferably 3 to 8 cm (1.2 to 3.1 inches). The staple fibers can be made by any process. For example, the staple fibers can be cut from continuous straight fibers using a rotary cutter or a guillotine cutter resulting in straight (i.e., non-crimped) staple fiber, or additionally cut from crimped continuous fibers having a saw tooth shaped crimp along the length of the staple fiber, with a crimp (or repeating bend) frequency of preferably no more than 8 crimps per centimeter. Preferably the staple fibers have crimp.

The staple fibers can also be formed by stretch breaking continuous fibers resulting in staple fibers with deformed sections that act as crimps. Stretch broken staple fibers can be made by breaking a tow or a bundle of continuous filaments during a stretch break operation having one or more break zones that are a prescribed distance creating a random variable mass of fibers having an average cut length controlled by break zone adjustment.

The process for utilizing wound packages of off-color filament yarn comprises the steps of:

a) obtaining a plurality of wound packages of off-color filament yarn;
b) classifying the plurality of wound packages, based on a pigment in the filament, into sets of wound packages;
c) converting a first set of wound packages into first staple fibers;
d) converting a second set of wound packages into second staple fibers;
e) mixing the first and second staple fibers of c) and d) to form an intimate blend of off-color staple fibers;

wherein at least 55 weight percent of the staple fibers in the intimate blend of off-color staple fibers is first staple fibers, based on the total weight of off-color staple fibers in the intimate blend of off-color staple fibers.

As used herein, the term "wound package" is meant to include continuous filament that is wound onto a core, bobbin, beam, or other winding support; with "core", "bobbin", "beam", and "winding support" used interchangeably herein. The wound package can further have any sort of protective wrapping, but such wrapping is clearly optional. In most fiber spinning operations, the wound packages are further packaged for shipment or storage, but such further packaging is optional.

As used herein, the phrase " . . . wound packages that contain off-color filament . . . " are considered to be:

i) wound packages of filament containing filament having linear lengths with pigment and linear lengths without pigment,
ii) wound packages of filament containing filament having an amount of pigment outside desired pigment amount limits,
iii) wound packages of filament containing filament having a linear length of one pigment and another linear length of a differing pigment,
iv) wound packages of filament containing filament having a mixture of different pigments, and each of those individual pigments are present in varying amounts linearly along the filament, or
v) any combination of i) to iv) thereof.

Off-color filament having linear lengths with pigment and linear lengths without pigment, of the wound packages of filament i), generally occur in the yarn manufacturing process during normal transitioning to a pigment-containing filament yarns from yarns having filament without pigment; and vice versa. These types of packages can also occur if the supply of pigment is interrupted during normal operation for some reason.

Off-color filament having an amount of pigment outside desired pigment amount limits, of the wound packages of filament ii), generally occur in the yarn manufacturing process when the amount of pigment injected drifts for some reason outside off pre-set manufacturing limits. Since the yarns are still pigmented, there is a potential to generate a large quantity of wound packages of this type, because typically this is a harder defect to detect.

Off-color filaments having a linear length of only one pigment and another linear length of only a differing pigment, of the wound packages of filament iii); and off-color filaments having a mixture of different pigments, and each of those individual pigments are present in varying amounts linearly along the filament, of the wound packages of filament iv); can occur in the yarn manufacturing process during transitioning from one pigment-containing filament yarn to a different pigment-containing yarn.

The wound packages are then classified into sets of wound packages, based on a pigment in the filament. In other words, wound packages having filaments having some blue pigment would be grouped together in one set of wound packages, wound packages having filaments having some green pigment would be grouped together as another set of wound packages, etc. If a wound package had filaments that contain linear lengths having only one pigment and other linear lengths with only a different pigment, or the wound package had a mixture of pigments, then the wound package could preferably be classified based on the dominant pigment in the filament, based on the weight or amount of pigment present.

At least 55 weight percent of the off-color staple fibers in the intimate blend of off-color staple fibers is first staple fibers; that is, they come from a set of wound packages that is classified based on a pigment in the filament. This means the off-color staple fiber blend, and yarns, fabrics, and articles made from the off-color staple fiber blend have a dominant color, which is the color of the first staple fibers. It has been found that use of a major amount of "one-color" off-color fibers in the intimate blend allows the incorporation of other colored staple fibers in the blend while retaining a shade of the color of the first staple fibers. This is important, because any process making pigmented fibers can generate many different colors of yarn, with varying amounts of waste yarn. The use of a dominant color in the blend allows small amounts of off-color fibers, of many different colors, to be used in the blend of staple fibers. The blend of staple fibers, and yarns, etc., made from the blend, would retain a shade of the color of the first staple fibers. Thus, the majority of all of the off-color pigmented yarns made by a fiber-making process can be utilized and do not have to go to the landfill or be otherwise disposed of.

Therefore, in some embodiments, at least 55 weight percent of the off-color staple fibers in the intimate blend of off-color staple fibers is first staple fibers, and the second staple fibers as defined herein make up 20 weight percent or less of the staple fibers in the intimate blend of off-color staple fibers, based on the total weight of off-color staple fibers in the intimate blend of off-color staple fibers. It is understood the first staple fibers and the second staple fibers are classified based on a different pigment in the filaments.

Additionally, in some embodiments of the process for utilizing wound packages of off-color filament yarn, after or concurrent with step d), one or more additional sets of wound packages of off-color filament yarn, each classified by a differing pigment, are converted into additional staple fibers, and those additional staple fibers are mixed in step e) with the staple fibers of c) and d) to form the intimate blend of off-color staple fibers. Further, in some further embodiments, each of the one or more additional sets of wound packages makes up no more than 20 weight percent or less of the staple fibers in the intimate blend of off-color staple fibers, based on the total weight of staple fibers in the intimate blend of off-color staple fibers.

Preferably, the off-color yarns only have defects relating to the amount or consistency of pigment in the filaments in the yarns wound in the package. In other words, preferably the yarns have mechanical properties (tenacity, modulus, etc.) that are within certain desired limits such that the yarns can adequately function in a desired application, such as cut protection. In some embodiments, it is desirable for the off-color yarns to have measured mechanical properties, such as tensile strength, tensile modulus, and/or elongation, that are either within first-grade limits of normal properties of yarns having filaments with no pigment defects (on-color filament); or if the measured mechanical properties of those off-color yarns are outside those limits, those measured mechanical properties are within 20 percent, and preferably within 10 percent, of those limits. In other words, in some embodiments, the off-color yarns have measured properties of tensile strength, tensile modulus, or elongation that lie outside of a desired first-grade specification range, but those measured properties are within 20 percent of either the upper or lower limit of the first-grade specification range. In some embodiments, the said measured properties are within 10 percent of either the upper or lower limit of the first-grade specification range.

In some embodiments of the process for utilizing wound packages of off-color filament yarn, the intimate blend of off-color staple fibers can be combined with third staple fibers obtained from a set of wound packages of only on-color filament to make a modified intimate blend of off-color staple fibers. By "wound packages of on-color filament" it is meant wound packages of filament containing only filament that has a desired pigment within desired pigment amount limits, or wound packages of filament containing only filament without any pigment, otherwise known as "natural" or "unpigmented" filaments. These wound packages can be considered wound packages having yarns and filaments that are free of known manufacturing defects with regards to the presence or absence of pigment. These wound packages can include what would normally be called "first grade" wound packages.

For avoidance of doubt, as used herein, "off-color staple fibers" are considered to be staple fibers made from wound packages that contain off-color filament; and "on-color staple fibers" are considered to be staple fibers made from wound packages of filament containing a desired pigment within desired pigment amount limits, or wound packages of natural filament containing only filament without any pigment. In other words, "on-color staple fibers" are staple fibers generally made from what would be called "defect-free" or "first grade" wound packages and can be either pigmented or natural (pigment-free). In some embodiments of this modified intimate blend of off-color staple fibers, 25 weight percent or more of the staple fibers in the modified intimate blend of off-color staple fibers is obtained from wound packages of off-color filament, based on the total weight of all of the staple fibers in the modified intimate blend of off-color staple fibers; that is, based on the total weight of all of the staple fibers obtained from the wound packages of off-color filament and the third staple fibers in the modified intimate blend of off-color staple fibers.

In some embodiments, the process for utilizing wound packages of off-color filament yarn further comprises the step of:

g) making a staple fiber yarn from the intimate blend of off-color staple fibers or the modified intimate blend of off-color staple fibers; or making a sheath-core yarn comprising a sheath of the intimate blend of off-color staple fibers or the modified intimate blend of off-color staple fibers, and a core comprising either inorganic or elastomeric filament, and optionally plying the staple fiber yarn or sheath-core yarn with another yarn to make a plied yarn.

By "yarn", it is meant an assemblage of fibers spun or twisted together to form a continuous strand. As used herein, a yarn generally refers to what is known in the art as a singles yarn, which is the simplest strand of textile material suitable for such operations as weaving and knitting; or a ply yarn or plied yarn. A spun staple yarn can be formed from staple fibers with more or less twist. When twist is present in a singles yarn, it is all in the same direction.

Spun staple yarn can be made from staple fibers using traditional long and short staple ring spinning processes that are well known in the art. However, it is not intended that yarn manufacture be limited to ring spinning because the yarns may also be spun using air jet spinning, open end spinning, and many other types of spinning that converts staple fiber into useable yarns. Spun staple yarns can also be made directly by stretch breaking using stretch-broken tow-to-top staple processes.

A sheath-core yarn has a sheath of the staple fibers and a core comprising either inorganic or elastomeric filament. The sheath/core construction is used because, in the case of the inorganic core yarn, the sheath staple fibers provide a cover and shield the inorganic filament from direct abrasive contact with the skin giving the fabrics containing the sheath/core yarn improved comfort. In the case of the elastomeric filament, the sheath provides a mechanical cover, as the elastomeric filament is not as durable as the sheath fibers.

The sheath fiber can be wrapped or spun around the inorganic filament core. Specifically, this can be achieved by known means, such as, conventional ring spinning including improvements to the conventional process such as those utilizing COTSON technology; core-spun spinning such as DREF spinning; air-jet spinning using so-called core insertion with Murata (now Muratec) jet-like spinning; open-end spinning, and the like. Preferably the staple fiber is consolidated around the inorganic filament core at a density sufficient to cover the core. The degree of coverage depends on the process used to spin the yarn; for example, core-spun spinning such as DREF spinning (disclosed, for example, in U.S. Pat. Nos. 4,107,909; 4,249,368; & 4,327,545) provides better coverage than ring spinning. Conventional ring spinning provides only partial coverage of the center core, but even partial coverage can provide adequate sheath/core coverage. The sheath can also include some fibers of other materials to the extent that decreased performance, such as decreased cut resistance, due to that other material, can be tolerated.

The incorporation of the at least one inorganic filament as the core of sheath-core yarn can be achieved, for example in one practical application, by passing a roving, sliver, or collection of staple fibers through sets of drafting rolls to make a drafted fiber mass to be ring twisted into a single yarn. The at least one inorganic filament is typically fed from a bobbin through a set of feed rolls and subsequently into the staple fibers prior to the final set of drafting rollers. Since the inorganic core filament(s) are not elastomeric they do not have to be over-tensioned during insertion into the yarn, with only enough tension applied to the sheath fibers and the core as is conventionally used.

The staple fiber sheath/inorganic core yarn generally comprises 15-50 weight percent inorganic filament(s) with a total linear sheath/core yarn density of 100 to 5000 dtex. The core comprising an inorganic fiber can be a single filament, or may be multifilament, and is preferably a single metal filament or several metal filaments, as needed or desired for a particular application or degree of cut protection. By metal filament is meant filament or wire made from a ductile metal such as stainless steel, copper, aluminum, bronze, tungsten and the like, or metal fiber constructions commonly known as "micro-steel". Stainless steel is the preferred metal. The metal filaments are generally continuous wires. Useful metal filaments are 1 to 150 micrometers in diameter and are preferably 25 to 75 micrometers in diameter.

In some embodiments, the inorganic fiber is a glass filament. It can be one or more glass filaments, such as for example 110 dtex (100 denier) glass filament. However, glass is less preferred because it has less cut resistance per linear density than metal and it is much more critical that the glass be substantially covered by the staple fiber sheath to minimize skin irritation should the yarn be used in gloves, sleeves, etc., where the fabric is in contact with the skin. Therefore, in many embodiments the inorganic fiber is not a glass filament but a metal filament.

The core comprising at least one continuous elastomeric filament is a core formed from or containing filaments of an elastomer, the core preferably having the ability to return to its original length rapidly after repeated stretching, even to at least twice its original length. Preferred elastomeric cores include polyurethane based yarns such as spandex or elastane; however, any fiber generally having stretch and recovery can be used. Suitable well-known elastomeric yarns also include the products sold under the tradenames Dorlastan® and Lycra®.

The preferred at least one continuous elastomeric filament is spandex fiber. As used herein, "spandex" has its usual definition, that is, a manufactured fiber in which the fiber-forming substance is a long chain synthetic polymer composed of at least 85% by weight of a segmented polyurethane. Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

In some processes for making spandex elastomeric filaments, coalescing jets are used to consolidate the spandex filaments immediately after extrusion. It is also well known that dry-spun spandex filaments are tacky immediately after extrusion. The combination of bringing a group of such tacky filaments together and using a coalescing jet will produce a coalesced multifilament yarn, which is then typically coated with a silicone or other finish before winding to prevent sticking on the package. Such a coalesced grouping of filaments, which is actually a number of tiny individual filaments adhering to one another along their length, is superior in many respects to a single filament of spandex of the same linear density.

The elastomeric filament in the elastomeric single yarn is preferably a continuous filament and can be present in the yarn in the form of one or more individual filaments or one or more coalesced grouping of filaments. However, it is preferred to use only one coalesced grouping of filaments in the preferred elastomeric sheath-core single yarn. Whether present as one or more individual filaments or one or more coalesced groupings of filaments, the overall linear density of the elastomer filament(s) in the relaxed state is generally between 17 and 560 dtex (15 and 500 denier) with the preferred linear density range being 44 to 220 dtex (40 to 200 denier).

It is preferred to incorporate the at least one continuous elastomeric filament in the sheath-core yarn under tension by drawing or stretching the at least one continuous elastomeric filament prior to the combination with staple fibers by using a slower delivery speed of the at least one continuous elastomeric filament relative to the final sheath/core yarn speed. This drawing can be described as the stretch ratio of the continuous elastomeric filament, which is the final sheath/core yarn speed divided by the delivery speed of the continuous elastomeric filament.

Typical stretch ratios are 1.5 to 5.0 with 1.5 to 3.50 being preferred. Low stretch ratios yield less elastic recovery while very high stretch ratios make the single yarns difficult to process and the fabric too tight and uncomfortable. The optimum stretch ratio is also dependent on the % weight content of elastomeric core. Tension devices can also be employed to tension and stretch the elastomeric fiber but are less preferred due to the difficulty in reproducing and controlling tension and stretch. The optimum stretch ratio is ultimately determined for each fabric, based on the desired fit and feel of the fabric.

The incorporation of the at least one continuous elastomeric filament into the sheath-core yarn containing the off-color staple fibers can be achieved, for example in one practical application, by passing a roving, sliver, or collection of the intimate blend of off-color staple fibers, or modified intimate blend of off-color staple fibers, through sets of drafting rolls to make a drafted fiber mass to be ring twisted into a single yarn. The at least one continuous elastomeric filament is typically fed from a bobbin through a set of feed rolls and subsequently into the staple fibers prior to the final set of drafting rollers. The slower relative surface speed of the feed rollers to the surface speed of the drafting rollers is increased or decreased to determine the amount of elastic stretch and tension in the final ring-twisted single yarn using conventional techniques.

In addition to conventional ring spinning, the sheath-core elastomeric singles yarn can be made by other conventional processes such as those utilizing COTSON technology; core-spun spinning such as DREF spinning; air-jet spinning using so-called core insertion with Murata (now Muratec) jet-like spinning; open-end spinning, and the like. Preferably the staple fiber is consolidated around the core of at least one continuous elastomeric filament at a density sufficient to cover the core. The degree of coverage depends on the process used to spin the yarn; for example, core-spun spinning such as DREF spinning (disclosed, for example, in U.S. Pat. Nos. 4,107,909; 4,249,368; & 4,327,545) provides better coverage than ring spinning. Conventional ring spinning provides only partial coverage of the center core, but even partial coverage is assumed a possible sheath/core structure herein.

In some embodiments, the process for utilizing wound packages of off-color filament yarn further comprises the optional step of plying the staple fiber yarn or sheath-core yarn with another yarn to make a plied yarn. As used herein the phrases "ply yarn" and "plied yarn" can be used interchangeably and refer to two or more yarns, i.e., singles yarns, that are twisted or plied together. Typically, when two singles yarns are twisted together to form a ply yarn, the twist direction in the ply yarn is opposite the twist direction in the singles yarns.

In some embodiments, the ply-twisted yarns are made by twisting together at least two individual single yarns. By the phrase "twisting together at least two individual single yarns", it is meant the two single yarns are twisted together without one yarn fully covering the other. This distinguishes ply-twisted yarns from covered or wrapped yarns where a first single yarn is substantially or completely wrapped around a second single yarn so that ideally only the first single yarn is exposed on the surface of the resulting covered yarn.

In one preferred embodiment, the ply-twisted yarn is made from at least two singles yarns, the first singles yarns having a sheath/core construction with the sheath comprising the intimate blend of off-color staple fibers or modified intimate blend of off-color staple fibers and the core comprising an inorganic fiber; and the second singles yarn having a sheath/core construction with a sheath comprising the intimate blend of off-color staple fibers or modified intimate blend of off-color staple fibers and a core comprising at least one continuous elastomeric filament. The second singles yarn is preferably free or substantially free of inorganic fibers. Each of the single yarns can have some twist. Such ply-twisted yarns are useful in cut-resistant fabrics, gloves, and articles, such as described and disclosed in U.S. Pat. No. 6,952,915 to Prickett.

In some embodiments, the ply-twisted yarns made from the two singles yarns have a total linear density of from 200 to 3000 dtex. In some embodiments, the individual staple fibers in either of the singles yarn can have a linear density of 0.5 to 7 dtex, with the preferred linear density range being 1.5 to 3 dtex. The ply-twisted yarns, and the single yarns that make up those ply-twisted yarns, can include other materials as long as the function or performance of the yarn or fabric made from that yarn is not compromised for the desired use. The ply-twisted yarns can be made from single yarns via well-known processes, such as disclosed in U.S. Pat. No. 6,952,915 to Prickett, and the ply-twisted yarns can have a wide range of ply twist as disclosed therein.

In some embodiments, the intimate blend of off-color staple fibers or the modified intimate blend of off-color staple fibers comprises off-color staple fiber obtained from off-color poly(paraphenylene terephthalamide) (PPD-T) wound packages; and in some embodiments, if on-color staple fibers are present, they are obtained from on-color PPD-T wound packages. Preferably, the PPD-T staple fibers has a 3.8 cm (1.5 inch) cut length and a filament density of 1.7 dtex per filament (1.5 denier per filament). In some embodiments, the staple sheath can be in the form of an 8 to 35 cotton count yarn.

In some preferred embodiments, the entire sheath of both inorganic core sheath-core yarn and the elastomeric core yarn comprises the intimate blend of off-color staple fibers or modified intimate blend of off-color staple fibers, and in some most preferred embodiments all of the staple fibers in both sheaths are obtained from wound packages of poly (paraphenylene terephthalamide) (PPD-T) filaments.

In one embodiment, an intimate blend sheath-inorganic core yarn and an intimate blend sheath-elastomeric core yarn are twisted together to form a ply-twisted yarn. In some embodiments, the ply-twisted yarn consists of only one intimate blend sheath-inorganic core yarn and a plurality of intimate blend sheath-elastomeric core yarns; and in other embodiments, the ply-twisted yarn consists of a plurality of intimate blend sheath-inorganic core yarns and only one intimate blend sheath-elastomeric core yarn. Likewise, in some embodiments the ply-twisted yarn consists of a plurality of intimate blend sheath-inorganic core yarns and a plurality of intimate blend sheath-elastomeric core yarns. Finally, in some embodiments, the ply-twisted yarn comprises at least one intimate blend sheath-inorganic core yarn and at least one intimate blend sheath-elastomeric core yarn, and other yarns made from any number of fibers can be included in ply-twisted yarn as long the final fabric meets the performance criteria, such as, for example, a desired cut resistance.

In some embodiments, the process for utilizing wound packages of off-color filament yarn can use the staple fiber yarn, the sheath-core yarn, or the plied yarn in an additional step of knitting or weaving a fabric. In some embodiments of the process for utilizing wound packages of off-color filament yarn by knitting a fabric from the staple fiber yarn, the sheath-core yarn, or the plied yarn, or directly knitting the staple fiber yarn, the sheath-core yarn, or the plied yarn into a glove, apron, sleeve, or other article.

Woven and/or knit fabric can comprise the ply-twisted yarns described herein. The preferred fabric is a knit fabric, and any appropriate knit pattern is acceptable. Cut resistance and comfort are affected by tightness of the knit and that tightness can be adjusted to meet any specific need. A very effective combination of cut resistance and comfort for many cut resistant articles has been found in, for example, single jersey and terry knit patterns. The fabrics preferably have a basis weight of about 4 to 30 oz/yd$^2$, preferably 6 to 25 oz/yd$^2$, the fabrics at the high end of the basis weight range providing more thermal and cut protection.

The staple fiber yarn, the sheath-core yarn, or the plied yarn can be used to form the fabric, or the ply-twisted yarns can then be combined with other, same, or different ply-twisted yarns to form a yarn bundle to form a fabric, depending on the desired fabric requirements. For example, two or more of the described ply-twisted yarns can be combined to form a yarn bundle that can be fed, with or without twist, to a knitting machine. Alternatively, a yarn bundle could be made with one or more of the described ply-twisted yarns with one or more different single yarn to impart desired properties to the final fabric. Since modern knitting machines can knit fabric from a feed of multiple ply-twisted yarns, the bundle of ply-twisted yarns fed to the machine need not have twist, although twist can be put into the bundle if desired.

Articles can comprise the ply-twisted yarns described herein, or articles can be made from the aforementioned fabrics comprising the ply-twisted yarns described herein. Especially useful articles include gloves, sleeves, and aprons.

In some embodiments, the cutting force of a fabric including the sheath-core yarn comprising an inorganic core is greater than or equal to 14.7 N, corresponding to cut level A4 or above in ANSI/ISEA 105; in some embodiments, the cutting force of a fabric made from that yarn is greater than or equal to 21.56 N, corresponding to cut level A5 or above in ANSI/ISEA 105; in some embodiments, the cutting force of a fabric made from that yarn is greater than or equal to 29.4 N, corresponding to cut level A6 or above in ANSI/ISEA 105; and preferably greater than or equal to 39.2 N, corresponding to cut level A7 or above in ANSI/ISEA 105.

Test Methods

The cut resistance of the fabrics knitted herein is determined according to the standard method in ISO 13997. A cut resistance tester TDM-100 is used to test the cutting force in N of a fabric sample knitted by use of 100% multi-ply twisted yarn to be tested. A large cutting force indicates a high cut resistance of the fabric. The cutting force is divided by the basic weight of the fabric and then is multiplied by 100 to obtain a cutting force index in $N/g/m^2$.

The cut level of the cut-resistant fabric or protective product in ANSI/ISEA105 or EN388 2016 can be obtained according to the cutting force of the fabrics knitted herein. According to ANSI/ISEA105, a load is exerted on a sharp straight-edged blade, and by the maximum load in grams (g), which can be exerted on the blade to ensure that a sample is not cut through after a 20-mm cutting distance of the blade, the cut resistance of the fabric can be classified into nine levels of level A1 to level A9, as listed in the Cut Level Table.

Cut Level Table

| Cut level | A1 | A2 | A3 | A4 | A5 | A6 | A7 | A8 | A9 |
|---|---|---|---|---|---|---|---|---|---|
| Cut load (g) | ≥200 | ≥500 | ≥1000 | ≥1500 | ≥2200 | ≥3000 | ≥4000 | ≥5000 | ≥6000 |
| Cutting force (N) | ≥1.96 | ≥4.9 | ≥9.8 | ≥14.7 | ≥21.56 | ≥29.4 | ≥39.2 | ≥49.0 | ≥58.8 |

Example 1

Sets of off-color poly(paraphenylene terephthalamide) (PPD-T) filament yarn wound on cores were classified by a pigment in the filaments. The resulting sets were designated by the color of a pigment in the yarn, and five sets of pigmented off-color yarn having blue, green, red, tan, and orange pigments. Each set of off-color yarn was then cut to make separate sets of pigmented staple fibers. All five sets of pigmented staple fibers were then combined in amounts as shown in Table 1 to make an intimate blend of the para-aramid fiber.

TABLE 1

| Pigment Color | Weight Percent |
|---|---|
| Blue | 60 |
| Green | 15 |
| Red | 15 |
| Tan | 5 |
| Orange | 5 |

The resulting intimate blend had 60 weight percent blue-pigmented staple, resulting in an intimate blend having an overall heather blue color. Staple yarn spun from the blend has a similar color. The high content by weight of the blue-pigmented staple satisfactory masked the use of other staple fibers of other colors in the intimate blend.

Example 2

A ply-twisted elastic yarn was made by ply twisting two sheath-core yarns. The first yarn was an 8.9 cotton count-sheath-core yarn having a para-aramid fiber sheath and a 63 micron stainless steel wire core, spun on a ring spinning frame. The para-aramid fiber was the intimate blend of Example 1. The second yarn was a 29.5-cotton count-sheath-core yarn made by core-spinning on a ring spinning frame the intimate blend of Example 1 around a 70-denier spandex core; the spandex core was stretched 3× as it was incorporated(spun) into the sheath-core yarn. The resulting ply-twisted elastic yarn made by ply twisting the first yarn and the second yarn had a total cotton count of 13.6/2. Relative amounts of the yarn components are shown in Table 2.

The resulting ply-twisted elastic yarn was knitted into a 13-gauge (fabric) glove on a Shima-Seiki glove knitting machine. The resulting glove had excellent hand and form-fitting properties. The knitted fabric and glove had a A7 cut level.

TABLE 2

| Component | Weight Percent of Ply-twisted yarn (%) | Weight Percent in Singles Yarn (%) |
|---|---|---|
| Intimate Blend Fiber | 63 | 49 |
| Steel Wire | 37 | 28 |
| Intimate Blend Fiber | 85 | 20 |
| Elastic Fiber | 15 | 3 |

Example 3

A ply-twisted elastic yarn was made by ply twisting three sheath-core yarns. The first two sheath core yarns were identical, each being a 26 cotton count-sheath-core yarn having a para-aramid fiber sheath and a 35 micron stainless steel wire core, spun on a ring spinning frame. The para-aramid fiber was the intimate blend of Example 1. The third yarn was a 29.5-cotton count-sheath-core yarn made by core-spinning on a ring spinning frame the intimate blend of Example 1 around a 70-denier spandex core; the spandex core was stretched 3× as it was incorporated(spun) into the sheath-core yarn.

The resulting ply-twisted elastic yarn made by ply twisting the three yarns together and had a total cotton count of 27/3. Relative amounts of the yarn components are shown in Table 3.

The resulting ply-twisted elastic yarn was knitted into a 15-gauge (fabric) glove on a Shima-Seiki glove knitting machine. The resulting glove had excellent hand and form-fitting properties. The knitted fabric and glove had a A5 cut level.

TABLE 3

| Component | Weight Percent of Ply-twisted yarn (%) | Weight Percent in Singles Yarn (%) |
|---|---|---|
| Intimate Blend Fiber | 66 | 23 |
| Steel Wire | 34 | 12 |
| Intimate Blend Fiber | 66 | 23 |
| Steel Wire | 34 | 12 |
| Intimate Blend Fiber | 85 | 26 |
| Elastic Fiber | 15 | 4 |

Example 4

A ply-twisted elastic yarn was made by ply twisting two sheath-core yarns. The first yarn was a 13.1 cotton count-sheath-core yarn having a para-aramid fiber sheath and a 53 micron stainless steel wire core, spun on a ring spinning frame. The para-aramid fiber was the intimate blend of Example 1. The second yarn was a 29.5-cotton count-sheath-core yarn made by core-spinning on a ring spinning frame the intimate blend of Example 1 around a 70-denier spandex core; the spandex core was stretched 3× as it was incorporated(spun) into the sheath-core yarn. The resulting ply-twisted elastic yarn made by ply twisting the first yarn and the second yarn had a total cotton count of 18.3/2. Relative amounts of the yarn components are shown in Table 4.

The resulting ply-twisted elastic yarn was knitted into a 15-gauge (fabric) glove on a Shima-Seiki glove knitting machine. The resulting glove had excellent hand and form-fitting properties. The knitted fabric and glove had a A5 cut level.

TABLE 4

| Component | Weight Percent of Ply-twisted yarn (%) | Weight Percent in Singles Yarn (%) |
|---|---|---|
| Intimate Blend Fiber | 60 | 42 |
| Steel Wire | 40 | 27 |
| Intimate Blend Fiber | 85 | 26 |
| Elastic Fiber | 15 | 5 |

Example 5

A ply-twisted elastic yarn was made by ply twisting two sheath-core yarns. The first yarn was a 24.1 cotton count-sheath-core yarn having a para-aramid fiber sheath and a 38 micron stainless steel wire core, spun on a ring spinning frame. The para-aramid fiber was the intimate blend of Example 1. The second yarn was a 32 cotton count-sheath-core yarn made by core-spinning on a ring spinning frame a sheath of nylon 6,6 staple around a 40-denier spandex core; the spandex core was stretched 3× as it was incorporated (spun) into the sheath-core yarn. The resulting ply-twisted elastic yarn made by ply twisting the first yarn and the second yarn had a total cotton count of 28/2. Relative amounts of the yarn components are shown in Table 5.

The resulting ply-twisted elastic yarn was knitted into an 18-gauge (fabric) glove on a Shima-Seiki glove knitting machine. The resulting glove had excellent hand and form-fitting properties. The knitted fabric and glove had a A4 cut level.

TABLE 5

| Component | Weight Percent of Ply-twisted yarn (%) | Weight Percent in Singles Yarn (%) |
|---|---|---|
| Intimate Blend Fiber | 63 | 36 |
| Steel Wire | 37 | 21 |
| Nylon 6,6 | 92 | 40 |
| Elastic Fiber | 8 | 3 |

Example 6

A ply-twisted elastic yarn was made by ply twisting two sheath-core yarns. The first yarn was a 24 cotton count-sheath-core yarn having a para-aramid fiber sheath and a 38 micron stainless steel wire core, spun on a ring spinning frame. The para-aramid fiber was the intimate blend of Example 1. The second yarn was a 32 cotton count-sheath-core yarn made by core-spinning on a ring spinning frame a sheath of InResST® recycled nylon 6,6 staple fiber around a 40-denier spandex core; the spandex core was stretched 3× as it was incorporated (spun) into the sheath-core yarn. The resulting ply-twisted elastic yarn made by ply twisting the first yarn and the second yarn had a total cotton count of 28/2. Relative amounts of the yarn components are shown in Table 6.

The resulting ply-twisted elastic yarn was knitted into an 18-gauge (fabric) glove on a Shima-Seiki glove knitting machine. The resulting glove had excellent hand and form-fitting properties. The knitted fabric and glove had a A4 cut level.

TABLE 6

| Component | Weight Percent of Ply-twisted yarn (%) | Weight Percent in Singles Yarn (%) |
|---|---|---|
| Intimate Blend Fiber | 63 | 36 |
| Steel Wire | 37 | 21 |
| Nylon 6,6 | 92 | 40 |
| Elastic Fiber | 8 | 3 |

Example 7

A ply-twisted elastic yarn was made by ply twisting two sheath-core yarns. The first yarn was a 12.8 cotton count-sheath-core yarn having a para-aramid fiber sheath and a 57 micron stainless steel wire core, spun on a ring spinning frame. The para-aramid fiber was the intimate blend of Example 1. The second yarn was an 18 cotton count-sheath-core yarn made by core-spinning on a ring spinning frame a sheath of nylon 6,6 staple around a 70-denier spandex core; the spandex core was stretched 3× as it was incorporated (spun) into the sheath-core yarn. The resulting ply-twisted elastic yarn made by ply twisting the first yarn and the second yarn had a total cotton count of 15/2. Relative amounts of the yarn components are shown in Table 7.

The resulting ply-twisted elastic yarn was knitted into a 13-gauge (fabric) glove on a Shima-Seiki glove knitting machine. The resulting glove had excellent hand and form-fitting properties. The knitted fabric and glove had a A5 cut level.

TABLE 7

| Component | Weight Percent of Ply-twisted yarn (%) | Weight Percent in Singles Yarn (%) |
|---|---|---|
| Intimate Blend Fiber | 44 | 33 |
| Steel Wire | 56 | 26 |
| Nylon 6,6 | 91 | 38 |
| Elastic Fiber | 9 | 3 |

Example 8

A ply-twisted elastic yarn was made by ply twisting two sheath-core yarns. The first yarn was a 9.2 cotton count-sheath-core yarn having a para-aramid fiber sheath and a 63 micron stainless steel wire core, spun on a ring spinning frame. The para-aramid fiber was the intimate blend of Example 1. The second yarn was a 26.4 cotton count-sheath-core yarn made by core-spinning on a ring spinning frame a sheath of nylon 6,6 staple around a 70-denier spandex core; the spandex core was stretched 3× as it was incorporated (spun) into the sheath-core yarn. The resulting ply-twisted elastic yarn made by ply twisting the first yarn and the second yarn had a total cotton count of 14/2. Relative amounts of the yarn components are shown in Table 8.

The resulting ply-twisted elastic yarn was knitted into a 13-gauge (fabric) sleeve on a Shima-Seiki glove knitting machine. The resulting sleeve had excellent hand and form-fitting properties. The knitted fabric and glove had a A6 cut level.

TABLE 8

| Component | Weight Percent of Ply-twisted yarn (%) | Weight Percent in Singles Yarn (%) |
|---|---|---|
| Intimate Blend Fiber | 60 | 39 |
| Steel Wire | 40 | 21 |
| Nylon 6,6 | 88 | 36 |
| Elastic Fiber | 12 | 4 |

Example 9

A ply-twisted elastic yarn was made by ply twisting two sheath-core yarns. The first yarn was an 9.2 cotton count-sheath-core yarn having a para-aramid fiber sheath and a 63 micron stainless steel wire core, spun on a ring spinning frame. The para-aramid fiber was the intimate blend of Example 1. The second yarn was a 26.4 cotton count-sheath-core yarn made by core-spinning on a ring spinning frame. For the sheath of this example, the intimate blend of Example 1 was further blended with natural first grade poly(paraphenylene terephthalamide) (PPD-T) fiber to form an intimate blend for the sheath containing 40 weight percent of the off-color PPD-T intimate blend of Example 1 and 60 weight percent of the on-color PPD-T fiber. The natural PPD-T fiber did not contain any pigment and had a natural golden color. The sheath fibers were spun around a 70-denier spandex core; the spandex core was stretched 3× as it was incorporated(spun) into the sheath-core yarn. The resulting ply-twisted elastic yarn made by ply twisting the first yarn and the second yarn had a total cotton count of 14/2. Relative amounts of the yarn components are shown in Table 9.

The resulting ply-twisted elastic yarn was knitted into a 13-gauge (fabric) glove on a Shima-Seiki glove knitting machine. The resulting glove had excellent hand and form-fitting properties. The knitted fabric and glove had a A7 cut level. Despite the use of the natural PPD-T fiber with the blue off-color staple fiber blend, the resulting yarns and knitted gloves still had an acceptable pleasing blue color.

TABLE 9

| Component | Weight Percent of Ply-twisted yarn (%) | Weight Percent in Singles Yarn (%) |
|---|---|---|
| Intimate Blend Fiber | 60 | 55 |
| Steel Wire | 40 | 28 |
| Intimate Blend Fiber | 88 | 14 |
| Elastic Fiber | 12 | 3 |

The invention claimed is:

1. A process for utilizing wound packages of off-color filament yarn, comprising:

a) obtaining a plurality of wound packages of off-color filament yarn, wherein the wound packages that contain off-color filament are:

i) wound packages of filament containing filament having linear lengths with pigment and linear lengths without pigment, ii) wound packages of filament containing filament having an amount of pigment outside desired pigment amount limits, iii) wound packages of filament containing filament having a linear length of one pigment and another linear length of a differing pigment, iv) wound packages of filament containing filament having a mixture of different pigments, and each of those individual pigments are present in varying amounts linearly along the filament, or v) any combination of i) to iv) thereof, b) classifying the plurality of wound packages, based on a pigment in the filament, into sets of wound packages;

c) converting a first set of wound packages into first staple fibers;

d) converting a second set of wound packages into second staple fibers;

e) mixing the first and second staple fibers of c) and d) to form an off-color intimate blend of staple fibers;

wherein at least 55 weight percent of the staple fibers in the intimate blend of off-color staple fibers is first staple fibers, based on the total weight of off-color staple fibers in the intimate blend of off-color staple fibers, wherein the intimate blend of off-color staple fibers have a dominant color, which is the color of the first staple fibers.

2. The process of claim 1, wherein the second staple fibers make up 20 weight percent or less of the staple fibers in the intimate blend of off-color staple fibers, based on the total weight of off-color staple fibers in the intimate blend of off-color staple fibers.

3. The process of claim 1, wherein after or concurrent with step d), one or more additional sets of wound packages of off-color filament yarn are converted into additional staple fibers, and those additional staple fibers are mixed in step e) with the staple fibers of c) and d) to form the intimate blend of off-color staple fibers.

4. The process of claim 3, wherein each of the one or more additional sets of wound packages makes up 20 weight percent or less of the staple fibers in the intimate blend of off-color staple fibers, based on the total weight of staple fibers in the intimate blend of off-color staple fibers.

5. A process for utilizing wound packages of off-color filament yarn, comprising:

a) obtaining a plurality of wound packages of off-color filament yarn, wherein the wound packages that contain off-color filament are:

i) wound packages of filament containing filament having linear lengths with pigment and linear lengths without pigment, ii) wound packages of filament containing filament having an amount of pigment outside desired pigment amount limits, iii) wound packages of filament containing filament having a linear length of one pigment and another linear length of a differing pigment, iv) wound packages of filament containing filament having a mixture of different pigments, and each of those individual pigments are present in varying amounts linearly along the filament, or v) any combination of i) to iv) thereof;

b) classifying the plurality of wound packages, based on a pigment in the filament, into sets of wound packages;

c) converting a first set of wound packages into first staple fibers;

d) converting a second set of wound packages into second staple fibers;

e) mixing the first and second staple fibers of c) and d) to form an off-color intimate blend of staple fibers;

wherein at least 55 weight percent of the staple fibers in the intimate blend of off-color staple fibers is first staple fibers, based on the total weight of off-color staple fibers in the intimate blend of off-color staple fibers, wherein the intimate blend of off-color staple fibers is further combined with third staple fibers obtained from a set of wound packages of only on-color filament to make a modified intimate blend of off-color staple fibers, wherein the wound packages of on-color filament are wound packages of filament containing only filament that has a desired pigment within desired pigment amount limits, or wound packages of natural filament containing only filament without any pigment.

6. A process for utilizing wound packages of off-color filament yarn, comprising:

a) obtaining a plurality of wound packages of off-color filament yarn, wherein the wound packages that contain off-color filament are:

i) wound packages of filament containing filament having linear lengths with pigment and linear lengths without pigment, ii) wound packages of filament containing filament having an amount of pigment outside desired pigment amount limits, iii) wound packages of filament containing filament having a linear length of one pigment and another linear length of a differing pigment, iv) wound packages of filament containing filament having a mixture of different pigments, and each of those individual pigments are present in varying amounts linearly along the filament, or v) any combination of i) to iv) thereof;

b) classifying the plurality of wound packages, based on a pigment in the filament, into sets of wound packages;

c) converting a first set of wound packages into first staple fibers;

d) converting a second set of wound packages into second staple fibers;

e) mixing the first and second staple fibers of c) and d) to form an off-color intimate blend of staple fibers;

wherein at least 55 weight percent of the staple fibers in the intimate blend of off-color staple fibers is first staple fibers, based on the total weight of off-color staple fibers in the intimate blend of off-color staple fibers, wherein 25 weight percent or more of the staple fibers in the modified intimate blend of off-color staple fibers is obtained from wound packages of off-color filament, based on the total weight of the staple fibers in the modified intimate blend of off-color staple fibers.

7. The process of claim 1 further comprising the step of:

g) making a staple fiber yarn from the intimate blend of off-color staple fibers or the modified intimate blend of off-color staple fibers; or making a sheath-core yarn comprising a sheath of the intimate blend of off-color staple fibers or the modified intimate blend of off-color staple fibers, and a core comprising either inorganic or elastomeric filament.

8. The process of claim 7 further comprising the step of knitting or weaving a fabric from the staple fiber yarn, the sheath-core yarn, or the plied yarn.

9. The process of claim 7 wherein the staple fiber yarn, the sheath-core yarn, or the plied yarn is knitted into a glove, apron, or sleeve.

10. An intimate blend of off-color staple fibers made by the process of claim 1.

11. A staple fiber yarn or a sheath-core yarn made by the process of claim 7.

12. A plied yarn made by the process of claim 7.

13. A knit or fabric made by the process of claim 8.

14. A glove, apron, or sleeve made by the process of claim 9.

15. The process of claim 7 further comprising plying the staple fiber yarn or sheath-core yarn with another yarn to make a plied yarn.

* * * * *